US007798542B2

(12) United States Patent
Frazier et al.

(10) Patent No.: US 7,798,542 B2
(45) Date of Patent: Sep. 21, 2010

(54) DOOR LOCK APPARATUS AND METHODS

(75) Inventors: Jeffery David Frazier, Portola Valley, CA (US); Kathleen Kostas Frazier, Portola Valley, CA (US); Leonard D. Bowersox, Fairfax Station, VA (US)

(73) Assignees: Jeffery D. Frazier, Portola Valley, CA (US); Kathleen K. Frazier, Portola Valley, CA (US)

( * ) Notice: Subject to any disclaimer, the term of this patent is extended or adjusted under 35 U.S.C. 154(b) by 192 days.

(21) Appl. No.: 11/946,213

(22) Filed: Nov. 28, 2007

(65) Prior Publication Data

US 2008/0087053 A1 Apr. 17, 2008

(51) Int. Cl.
*E05C 19/18* (2006.01)
*E05C 17/54* (2006.01)

(52) U.S. Cl. ..... 292/288; 292/258; 292/289; 292/292; 292/343; 292/DIG. 15; 292/DIG. 21; 292/DIG. 71

(58) Field of Classification Search ..... 292/258, 292/288, 289, 292, 295, 342, 343, DIG. 15, 292/DIG. 21, DIG. 71; 16/82
See application file for complete search history.

(56) References Cited

U.S. PATENT DOCUMENTS

| | | | | | |
|---|---|---|---|---|---|
| 95,231 | A | * | 9/1869 | Jones | 292/288 |
| 694,975 | A | * | 3/1902 | Marshall | 292/262 |
| 761,955 | A | * | 6/1904 | Glock et al. | 292/292 |
| 786,831 | A | * | 4/1905 | McMahom | 292/343 |
| 1,787,734 | A | * | 1/1931 | Rowling | 248/73 |
| 1,919,780 | A | * | 7/1933 | Fairbank | 52/584.1 |
| 2,151,587 | A | * | 3/1939 | Cassileth | 292/288 |
| 2,172,610 | A | * | 9/1939 | Frank | 292/288 |
| 2,396,982 | A | * | 3/1946 | Bousquet | 292/289 |
| 2,899,229 | A | * | 8/1959 | Jenks | 292/288 |
| 3,648,411 | A | | 3/1972 | Saunders et al. | |
| 4,105,232 | A | * | 8/1978 | Miels | 292/288 |
| D302,939 | S | * | 8/1989 | Ruskin | D8/402 |

(Continued)

FOREIGN PATENT DOCUMENTS

| | | | |
|---|---|---|---|
| DE | 3514244 | A1 * | 10/1986 |
| GB | 2131866 | A * | 6/1984 |

OTHER PUBLICATIONS

Safety 1st Cabinet Slide Lock, item 12014A, as seen at drugstore.com web page.

*Primary Examiner*—Carlos Lugo
(74) *Attorney, Agent, or Firm*—Jeffery D. Frazier; Leonard D. Bowersox

(57) ABSTRACT

A door lock apparatus and methods are provided for preventing a child, or other unauthorized person, from opening an appliance (e.g., refrigerator) or cabinet door, while not unduly reducing or impeding access thereto by an authorized person, such as an adult. In various embodiments, the door lock apparatus is configured for locking in place outwardly swinging doors disposed in a side-by-side relationship. For example, a generally "U" or "V" shaped door lock can be adapted, when in a generally inverted orientation, to be slidably and removably received within channels or recesses formed by closely adjacent elongated handles of respective side-by-side doors. In some embodiments, the door lock apparatus can include, among other things, spaced legs depending from an upper support.

19 Claims, 10 Drawing Sheets

U.S. PATENT DOCUMENTS 5,152,564 A 10/1992 Martineau
5,209,533 A 5/1993 Menard
5,222,619 A * 6/1993 Gregory ..... 220/324
5,294,160 A * 3/1994 Arthur ..... 292/258
5,358,293 A 10/1994 Bradley, Jr. et al.
5,387,018 A * 2/1995 Pinkerton ..... 292/259 R
5,402,553 A 4/1995 Goetz et al.
5,412,839 A 5/1995 McCollom
5,501,493 A * 3/1996 Arthur ..... 292/258
5,588,687 A * 12/1996 Pinkerton ..... 292/259 R
5,606,771 A * 3/1997 Young ..... 16/90
5,642,910 A * 7/1997 Betherum ..... 292/288
5,664,815 A * 9/1997 Kornder ..... 292/288
5,709,422 A * 1/1998 Malone ..... 292/288
5,934,718 A * 8/1999 La Valle ..... 292/289
D418,038 S * 12/1999 Scott ..... D8/330
6,018,968 A * 2/2000 Sides ..... 70/14
6,609,739 B1 * 8/2003 Avganim ..... 292/295
7,344,167 B2 * 3/2008 Johnson et al. ..... 292/288

* cited by examiner 100
510
540
530
520
580
570
410
400
180
160
130
215
200
120
340
340

DOOR LOCK APPARATUS AND METHODS

FIELD

The present teachings relate to appliance and cabinet locking apparatus and methods, such as refrigerator door locking apparatus and methods having utility, e.g., for limiting or preventing unauthorized opening of a refrigerator or other cabinet structure, such as by young children or various other unauthorized persons.

BACKGROUND

Doors and associated elongated handles on refrigerators or cabinets of the so-called side-by-side design can run most or all of the full length of the refrigerator or cabinet from a top region to a bottom region, the latter of which can be near the floor. Because such doors are typically not latched and can be disposed close to the floor, a small child or other unauthorized person (e.g., a a person not able to safely or effectively operate such doors) could open a refrigerator door and, in some instances, leave the door ajar after leaving the refrigerator area. Leaving a refrigerator door open for long and unnecessary periods of time can waste electricity and cause the refrigerator compressor to work harder, which may result in damage to the compressor motor. Prior refrigerator and cabinet door locks are typically cumbersome and hamper or impede convenient access to the refrigerator or cabinet by authorized persons, such as adults.

SUMMARY

The present teachings provide door lock apparatus and methods, useful, for example, with refrigerators or other cabinets having doors disposed in a side-by-side configuration. In various embodiments, such apparatus and methods are useful, for example, to prevent unauthorized persons, such as children or other unauthorized persons, from opening a refrigerator or cabinet door, while at the same time permitting convenient access by authorized persons, such as adults.

For example, according to various embodiments, a generally "U" or "V" shaped door lock apparatus, disposed in an inverted orientation, can be adapted to be received within channels or recesses formed by vertically extending, adjacent handles of side-by-side doors. Such channels or recesses can, at least in part, define grasping regions adapted for opening refrigerator or cabinet doors. In some embodiments, a door lock apparatus as taught herein can include, among other things, spaced legs depending from an upper support. In some embodiments, a door lock apparatus as taught herein can include a tether device (also referred to herein as a tether means or attachment means), such as a flexible strap, string, ribbon, rope, or the like, for tethering or attachment to a refrigerator or cabinet. Particularly in the case of refrigerators, such tether means can, in some embodiments, be provided with a magnet secured at a distal end from the door lock apparatus, permitting magnetic attachment of the door lock apparatus to a refrigerator surface (e.g., a side, front or top panel). Additional embodiments provide, for example, a magnetic material (e.g., one or more magnetic strips or pieces) comprising at least a portion of, or attached directly to a surface of, the door lock apparatus. Some such embodiments can be useful, for example, to prevent or lessen the likelihood of loss or misplacement of the door lock apparatus. Further, some such embodiments can be useful, for example, to ensure or increase the probability that the door lock apparatus is kept in a convenient location for use. Still further, some such embodiments can provide, for example, substantially secure, yet readily removable, attachment of the door lock apparatus to a refrigerator surface, such as a front surface panel. In some embodiments, direct magnetic attachment of the door lock apparatus to a surface of an appliance, when not in active use, can be useful as a means for conveniently storing the door lock and reducing the chances of misplacement, such that it will be readily available when needed).

BRIEF DESCRIPTION OF DRAWING FIGURES

Various embodiments are depicted in the drawing figures, which are described in brief below.

DESCRIPTION OF VARIOUS EMBODIMENTS

In many configurations, a refrigerator door handle can be an elongated part including a mounting portion and a grip portion. The mounting portion can include a flat region positionable flush against the face or edge of the refrigerator door. Screws, rivets, bolts, glue, or other suitable fastening means can be used to secure the door handle to the refrigerator door. Refrigerators can be provided with so-called "soft feel" handles. That is, handles which feel soft to the touch of users. In many configurations, an elongated handle, such as a soft-feel handle, extends substantially all along a respective vertical edge of a door of a side-by-side refrigerator. Some refrigerators, as will be appreciated by those skilled in the art, include generally vertically extending handles which do not extend along the entire vertical length of the doors, but nevertheless extend along a substantial portion thereof (e.g., approximately one third the vertical length, or greater).

In accordance with some embodiments, there is provided a refrigerator with two or more cabinets and two or more respective doors, one for each cabinet, providing access to the interior of the cabinets. In some embodiments, a handle assembly includes an elongated base portion attached to and extending along one side of a respective door and an elongated grasping portion overlapping and spaced forward of the respective door front. A distal edge of the grasping portion can be return bent to form a first elongated channel or recess on the door side of the grasping portion and a second elongated recess can be formed on the door side of the handle and to the opposite side of the grasping portion from the first recess. In some embodiments, an elongated soft feel liner is provided with lateral edges received within the recesses.

Figure 1:
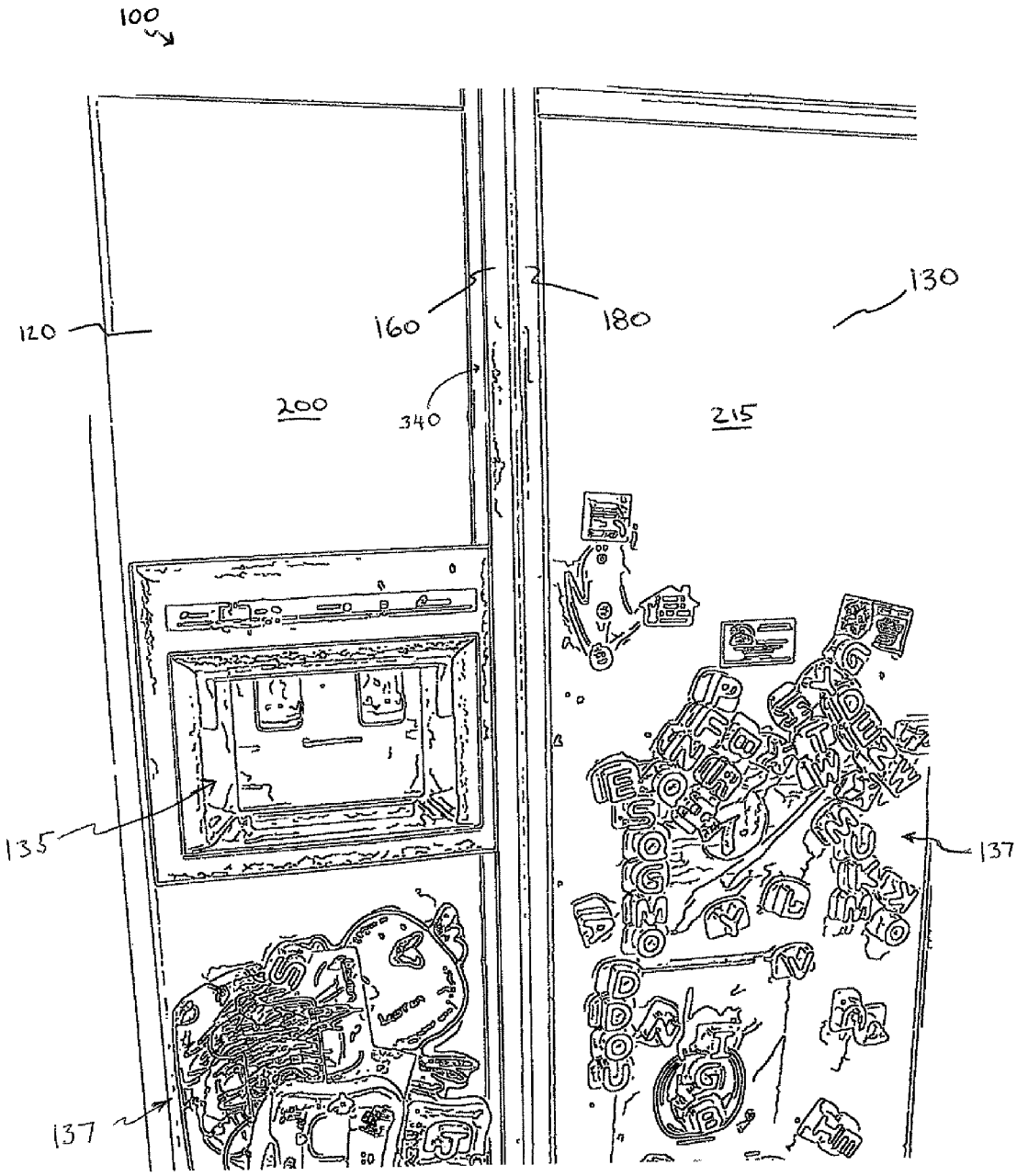
FIG. 1 is a front view of a refrigerator including side-by-side doors, in accordance with various embodiments.

Referring now to FIG. 1, there is illustrated a household refrigerator 100 of the side-by-side type. Refrigerator 100 can include, for example, a fresh food compartment, toward one side, and a freezer compartment, on an adjacent side. Each of the compartments can include, for example, a front access opening normally closed by pivotally attached (e.g., hinged) doors 120, 130, respectively. As can be seen in FIG. 1, ice and cold water dispensers can be provided, as at 135, in a recessed portion within one of the doors, such as door 120.

The particular refrigerator configuration shown is for illustrative purposes only, and it will be understood by those skilled in the art that the present teachings are useful with other appliances and cabinet structures, including, e.g., tall cabinets (e.g., 5 feet tall, or higher), other types of refrigerators, freezers, wine refrigerators, and the like. Various internal components of a refrigerator, such as the refrigeration system and the storage shelves, have been omitted in this description for the sake of simplicity.

Many household refrigerators are comprised of materials, e.g., steel sheets, allowing magnets to attach thereto. For illustrative purposes, magnetically attached toys, pictures, decals, and such, are shown on the front surface of the refrigerator 100 of FIG. 1, denoted generally by the reference numeral 137. Such items axe generally located along the lower portion (e.g., lower half) of the front surface, as children can typically access such areas and often enjoy playing with a variety of magnetically attachable paraphernalia on the refrigerator front surface. Children, however, are typically not tall enough to reach the upper regions of the refrigerator front surface, thus the refrigerator 100 of FIG. 1 is devoid of such items on its upper portion (e.g., upper half).

Figure 2:
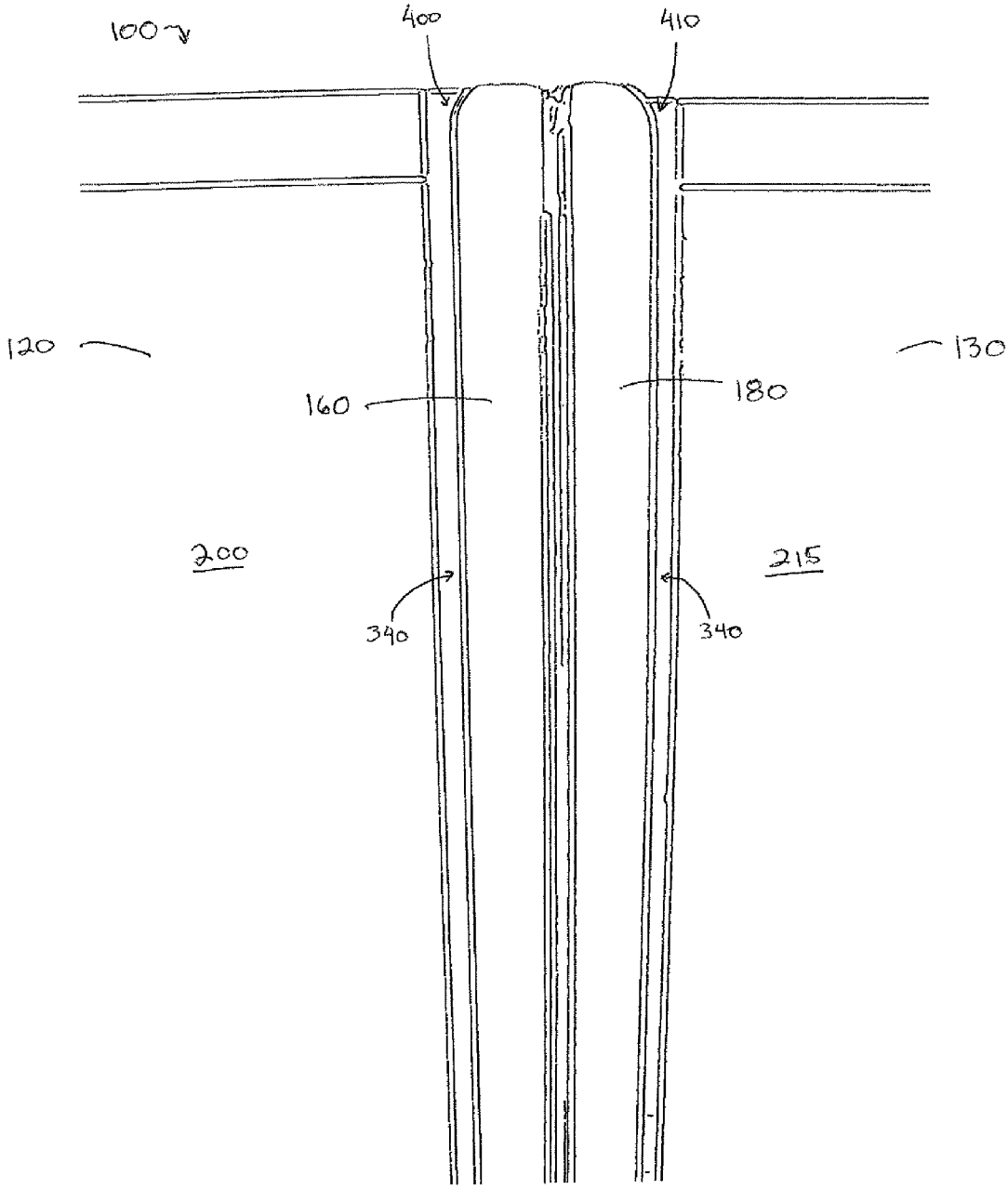
FIG. 2 shows an upper region (upper half) of the refrigerator of FIG. 1, in accordance with various embodiments.

Referring additionally to FIG. 2, doors 120, 130 can be provided with handles 160, 180, respectively, by which a user, such as an authorized adult, can open and close each door for access to a corresponding compartment. Further, it can be seen that doors 120, 130 include respective front panels 200, 215. The panels can be formed, for example, from one or more sheets of structural material, such as steel, which is formed into a desired shape, such as that shown in the drawings.

Handles 160, 180 can extend substantially from the top to the bottom of doors 120, 130. The handles can be mounted on the doors by any suitable means, such as by screws, rivets, bolts, adhesives, or other means, including those described in U.S. Pat. No. 5,412,839; incorporated herein by reference in its entirety. Handles 160, 180 can include respective elongated base portions which extend along respective portions of front panels 200, 215. Handles 160, 180 can also include respective grasping portions, each denoted generally by the reference numeral 340; each of which overlies, is spaced forward of and is generally parallel to, or curved back over, the respective front panel 200, 215. In some embodiments, the grasping portion 340 and base portion are joined by a smoothly curved or radiused portion. The distal edge of each grasping portion 340 can be return bent to form first and second channels or recesses, as at 400 and 410 (FIG. 2). For each door, such channel or recess can provide areas for the insertion of fingers by a user, who can then pull outward on the portion of the handle that is spaced forward of the front panel, thereby opening the door.

Figure 3:
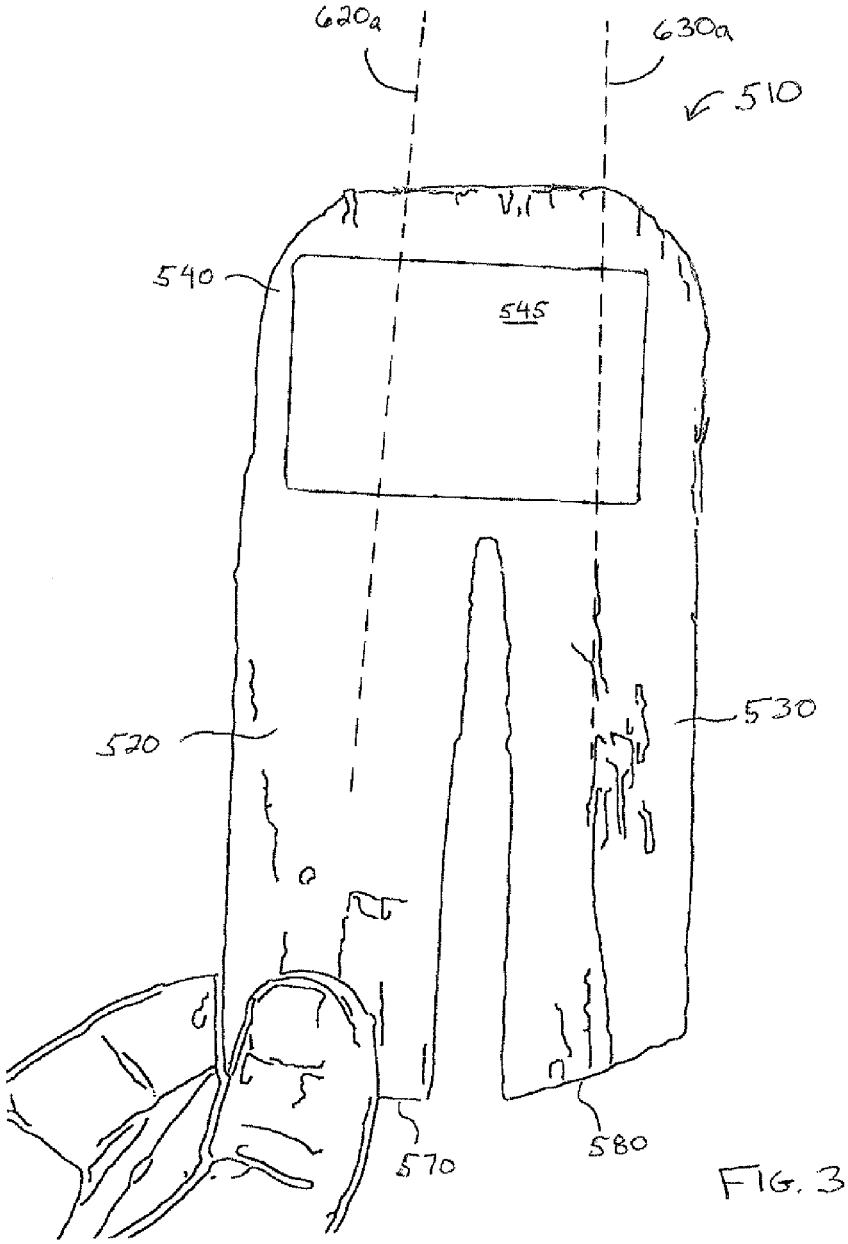
FIG. 3 is a front view of a door lock apparatus, in accordance with various embodiments, supported by hand.

With further regard to the door lock apparatus and methods of the present teachings, FIG. 3 depicts a door lock apparatus, denoted generally by the reference numeral 510. The door lock apparatus and methods of the present teachings can be useful, among other things, with refrigerators or other cabinets having doors disposed in a side-by-side configuration, such as described above. In various embodiments, such apparatus and methods can be useful, for example, to prevent unauthorized persons, such as children or other unauthorized persons, from opening a refrigerator or cabinet door, while at the same time permitting convenient access by authorized persons, such as adults.

For example, according to various embodiments, a generally "U" or "V" shaped door lock apparatus 510, disposed in a generally inverted orientation as shown in FIG. 3, can be adapted to be received within channels or recesses formed by vertically extending, adjacent handles of side-by-side doors. Such channels or recesses can, at least in part, define grasping regions adapted for opening refrigerator or cabinet doors by hand (such as described above). The door lock apparatus of FIG. 3 includes spaced legs 520, 530 depending from an upper support or web 540, also referred to as a bridge or bridge portion. In some embodiments, spaced legs 520, 530 can be evenly spaced from each other along the entire length of the door lock apparatus. In some embodiments, the spacing between legs 520 and 530 can become wider in a direction from web 540 toward the distal ends of legs 520 and 530. In some embodiments, the spacing between legs 520 and 530 can become narrower in a direction from web 540 toward the distal ends of legs 520 and 530.

According to various embodiments, each of legs 520 and 530 has a length and a width, and web 540 has a width that extends in the same direction as the widths of the legs. In some embodiments, the length of each of legs 520 and 530 can be from about 75% to about 200%, for example, from about 100% to about 150%, or from about 110% to about 130% of the width of the web 540. Web 540 can also have a length that extends in the same direction as the length of each of legs 520 and 530, although the length of web 540 may be less than the width of web 540, as shown in FIG. 3. In some embodiments, the length of web 540 can be from about 50% to about 150% of the width of web 540, for example, from about 100% to about 140% or from about 110% to about 130% of the width of web 540. In some embodiments, the length of web 540 can be from about 25% to about 150% of the length of either of legs 520 and 530, for example, from about 50% to about 100% or from about 60% to about 75% of the length of either of legs 520 and 530.

In the illustrated configuration, the door lock apparatus is primarily comprised of wood; for example, a lightweight, yet sturdy and durable wooden material; e.g., balsa wood, plywood, pine wood, oak wood, and the like. Additional materials can be used, as well. For example, the door lock apparatus can comprise a plastic or polymer (e.g., polyethylene; polyurethane; polytetrafluoroethylene, polypropylene, and the like), a metal or metal alloy (e.g., aluminum; steel, iron, titanium; chromium molybdenum (chromo, chromoly, chromoly)); and the like), carbon fiber, or any materials like or similar to the foregoing materials, and any combinations thereof.

In some embodiments, a door lock apparatus as taught herein can include a tether device (also referred to herein as a tether means or attachment means), such as a flexible strap, string, ribbon, rope, wire, line (e.g., nylon line), or the like, for tethering or attachment to a refrigerator or cabinet. Particularly in the case of refrigerators, such tether means can, in some embodiments, be provided with a magnet secured at a distal end from the door lock apparatus, permitting tethered, magnetic attachment of the door lock apparatus to a refrigerator surface (e.g., a side, front or top panel).

Additional embodiments of a door lock apparatus comprise, at least in part, a magnetic material. In some embodiments, a magnetic material is embedded in and/or attached to a surface of the door lock apparatus, such as the substantially planar, rectangular strip of magnetic material depicted in FIG. 3 which is denoted by reference numeral 545. In the illustrated configuration, the magnetic strip 545 is attached to a surface of the door lock apparatus 510, along the support or web region 540, by an adhesive, such as a strong glue or epoxy. Other attachment means can be used in addition or as an alternative to such adhesive; e.g., tacks, nails, rivets, screws, bolts, staples, and the like. Some such embodiments including a magnetic attachment means can be useful, for example, to prevent or lessen the likelihood of loss or misplacement of the door lock apparatus. Further, some such embodiments can be useful, for example, to ensure or increase the probability that the door lock apparatus is kept in a convenient location for use. Still further, some such embodiments can provide, for example, substantially secure, yet readily removable, attachment of the door lock apparatus to a refrigerator surface, such as a front surface panel.

With further regard to magnetic strips for attachment to the door lock apparatus 510, so-called "peel and stick" magnetic stripping, which can be applied to a door lock apparatus as taught herein, is available commercially, such as from Master Magnetics, Inc. of Castle Rock, Colo.; among other sources. Suitable magnetic stripping is available in a variety of sizes, and can conveniently be cut to a desired shape and size. The adhesive side of such strips is configured to permit secure adhesive-based attachment to paper, cardboard, wood, plastic, polymers, metal, and other materials. The magnetic strip side, in turn, can cling securely to a steel surface, such as a refrigerator panel.

Refrigerator door lock apparatus 510 can be of a unitary construction (e.g., monolithic), or comprised of two or more parts attached to one another (e.g., by fasteners, glue, epoxy, screws, nails, bolts, rivets, tongue-in-groove arrangements, and the like). In some embodiments, a generally "U" or "V" shaped door lock apparatus 510 permits the legs 520, 530 to be deflected (e.g., at least slightly outward) relative to one another upon an application of force, such as by sliding, pressing engagement with the upper ends of a pair of adjacent refrigerator door handles. The legs can be, for example, resiliently deflectable, such that they substantially return to their initial position after being deflected, and the deflecting force is substantially reduced or removed. In some embodiments, the left and right leg members 520, 530 are joined by a connecting support or web 540 to define an essentially continuous, generally "U" or "V" shaped configuration, with the left and right leg members 520 and 530 including respective left and right leg lower distal ends 570 and 580, each defined by a thickness, between a front face and a rear face (See FIG. 5, reference letter "$T_1$"). Further, in some embodiments, the legs can define respective left and right axes, such as depicted by dotted lines 620*a* and 630*a*, wherein the axes 620*a* and 630*a* can be substantially aligned in a common plane. Axes 620*a*, 630*a* can be substantially parallel to one another, or may form an angle (e.g., an acute angle, such as in the range of 1-60 degrees, 3-45 degrees, 5-35 degrees, or 10-30 degrees) respective to one another.

In various embodiments, the leg members attach to one another at their upper ends. The attachment can be rigid, or can allow for pivoting action. For example, a hinge, rivet, or similar pivoting fastener, can attach the leg members to one another. This can allow swinging motion of the leg members about an axis.

In some embodiments, the leg members are normally biased towards one another, such that they return towards each other after they have been moved apart from one another. For example, a contraction spring or other biasing means can act to pull the legs towards one another. A stop device can be provided, to maintain a desired distance between the biased leg members. In various embodiments, the stop is adjustable so that the distance between the leg members can be adjusted, as desired. For example, the stop can comprise a threaded screw, having mating threads formed laterally (side-to-side) through one of the leg members, and a blunt terminal end for engaging a facing surface of the other leg member, thereby maintaining a desired amount of separation therebetween. Other embodiments provide, for example, an internal or external spring force, biasing the legs towards one another, such as the spring means found on common clothes pins.

Additional aspects of the door lock apparatus of the present teachings, and methods, will now be described.

Figure 4:
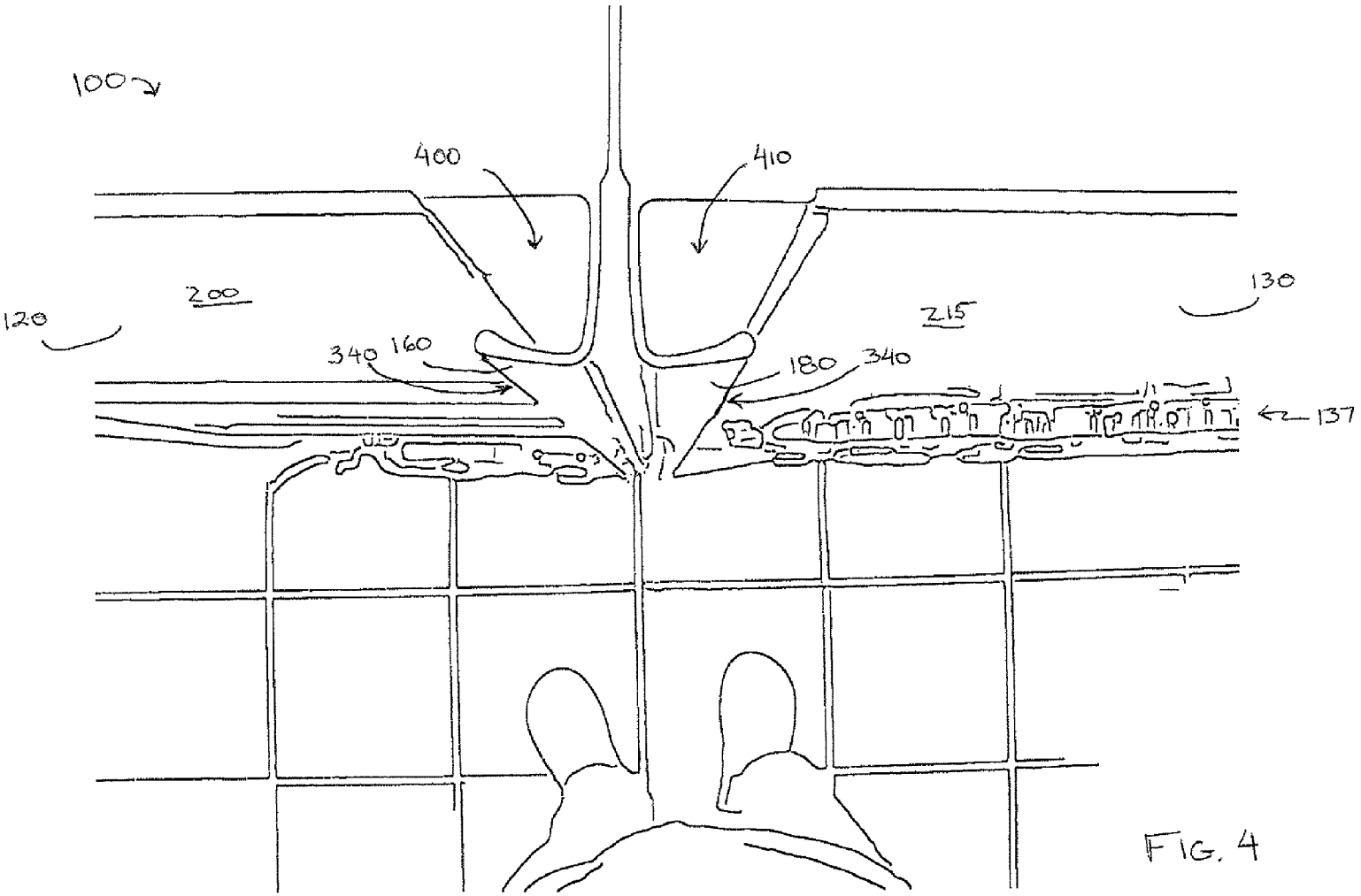
FIG. 4 is a view from above the refrigerator of FIG. 1, with an adult standing in front of it, in accordance with various embodiments.

FIG. 4 is a view from above the refrigerator 100 of FIG. 1, with an adult standing in front of it, in accordance with various embodiments. Although not shown in FIG. 4, the adult is holding the door lock apparatus 510, as depicted in FIG. 3.

Figure 5:
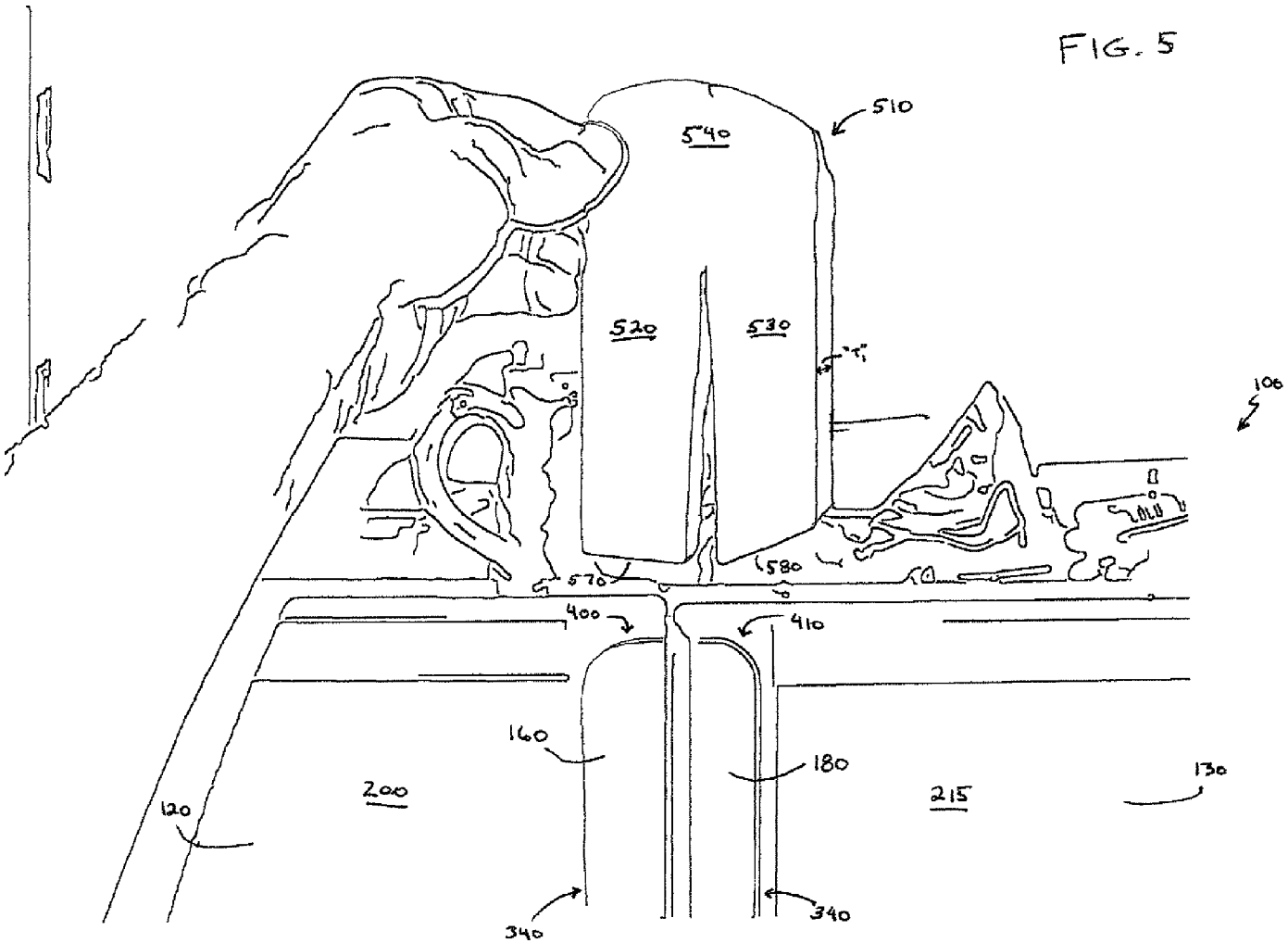
FIG. 5 is a front view showing the door lock apparatus of FIG. 3 being held by the adult of FIG. 4 slightly above the refrigerator and associated handles, in accordance with various embodiments.

FIG. 5 is a front view showing the door lock apparatus 510 of FIG. 3 being held by the adult of FIG. 4 slightly above the refrigerator 100 and associated handles 160, 180, in accordance with various embodiments. The adult, in this instance, is preparing to lock the refrigerator doors.

Figure 6:
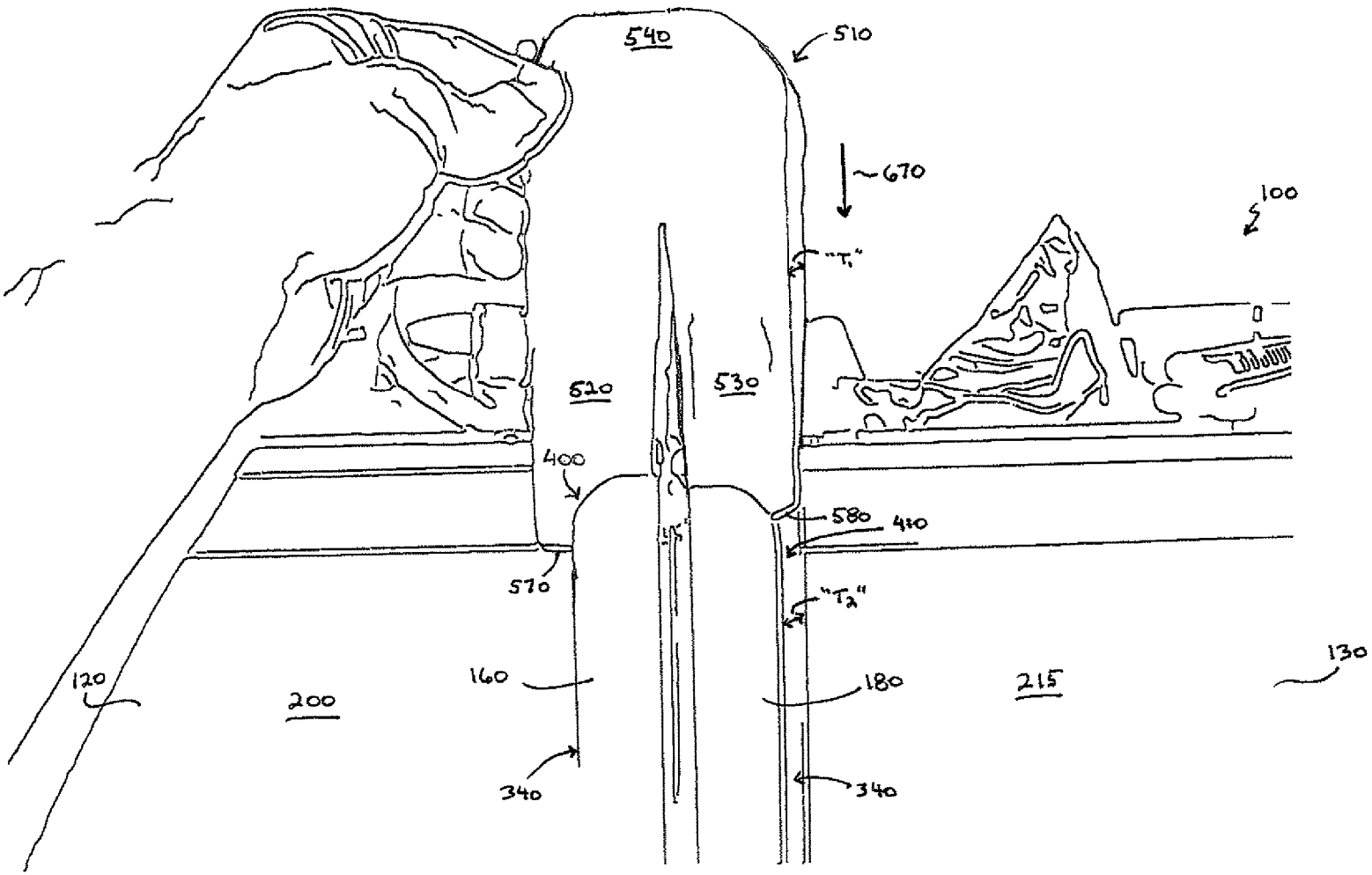
FIG. 6 is a front view, of the arrangement of FIG. 5, with the door lock apparatus being lowered by the adult of FIG. 4 so that depending legs thereof are received within respective channels formed by the refrigerator handles, in accordance with various embodiments.

FIG. 6 is a front view, of the arrangement of FIG. 5, with the door lock apparatus 510 being lowered, in the direction indicated by arrow 670, by the adult of FIG. 4, so that depending legs 520, 530 thereof are received within respective channels 400, 410 formed by the refrigerator handles 160, 180, in accordance with various embodiments. Channels 400, 410 are configured, in this embodiment, with a front-to-rear width, denoted as "$T_2$," slightly greater than the thickness "$T_1$" of door lock apparatus 510, so that the door lock is snugly received therein, yet allowing for easy sliding (both up and down) of the legs of the door lock apparatus within the channels formed by the handles.

Figure 7:
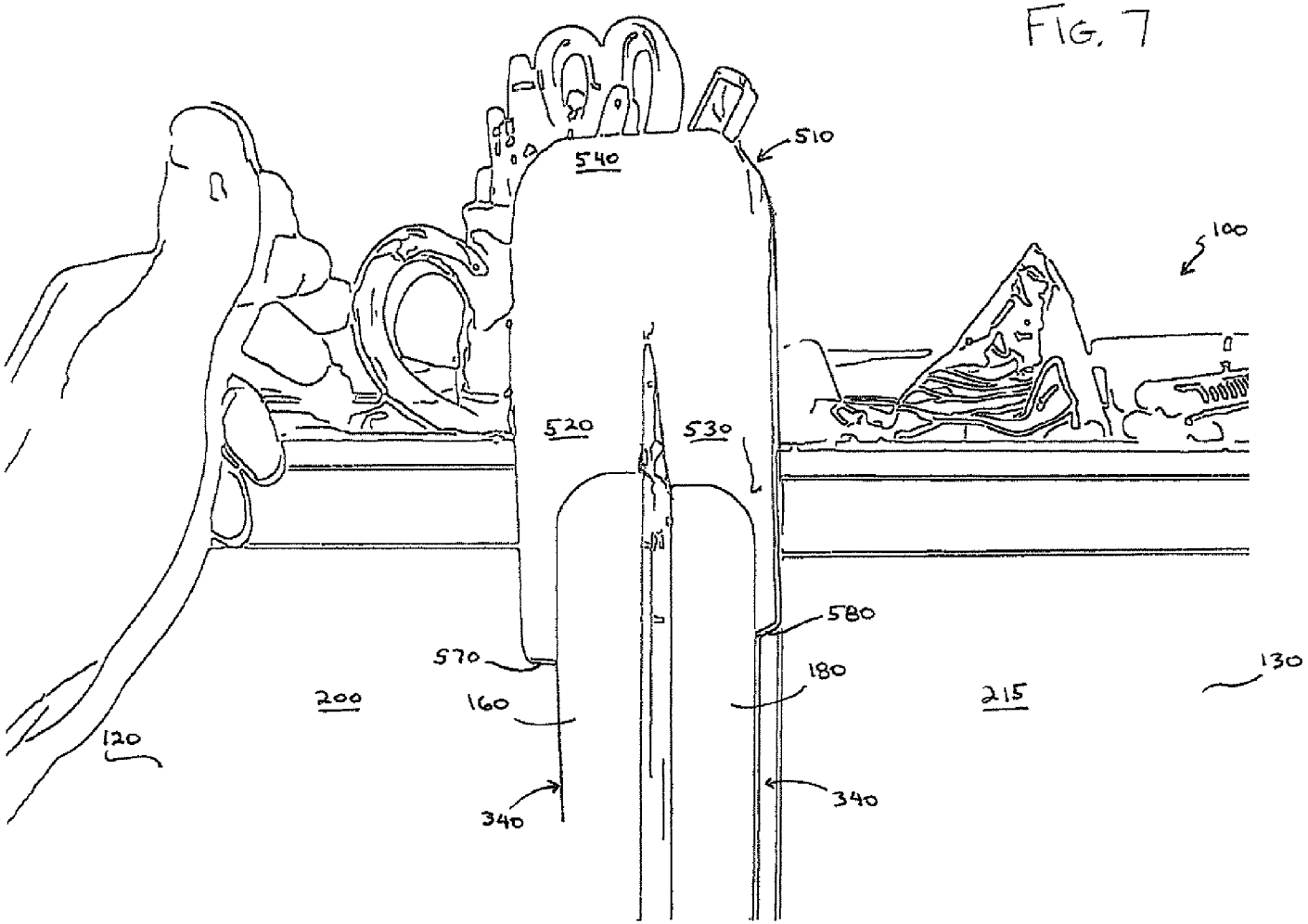
FIG. 7 is a front view, of the arrangement of FIGS. 5 and 6, with the door lock apparatus seated in place, thereby locking the doors in a closed position, in accordance with various embodiments.

FIG. 7 is a front view, of the arrangement of FIGS. 5 and 6, with the door lock apparatus 510 seated in place, thereby locking the doors 120, 130 in a closed position, in accordance with various embodiments.

Figure 8:
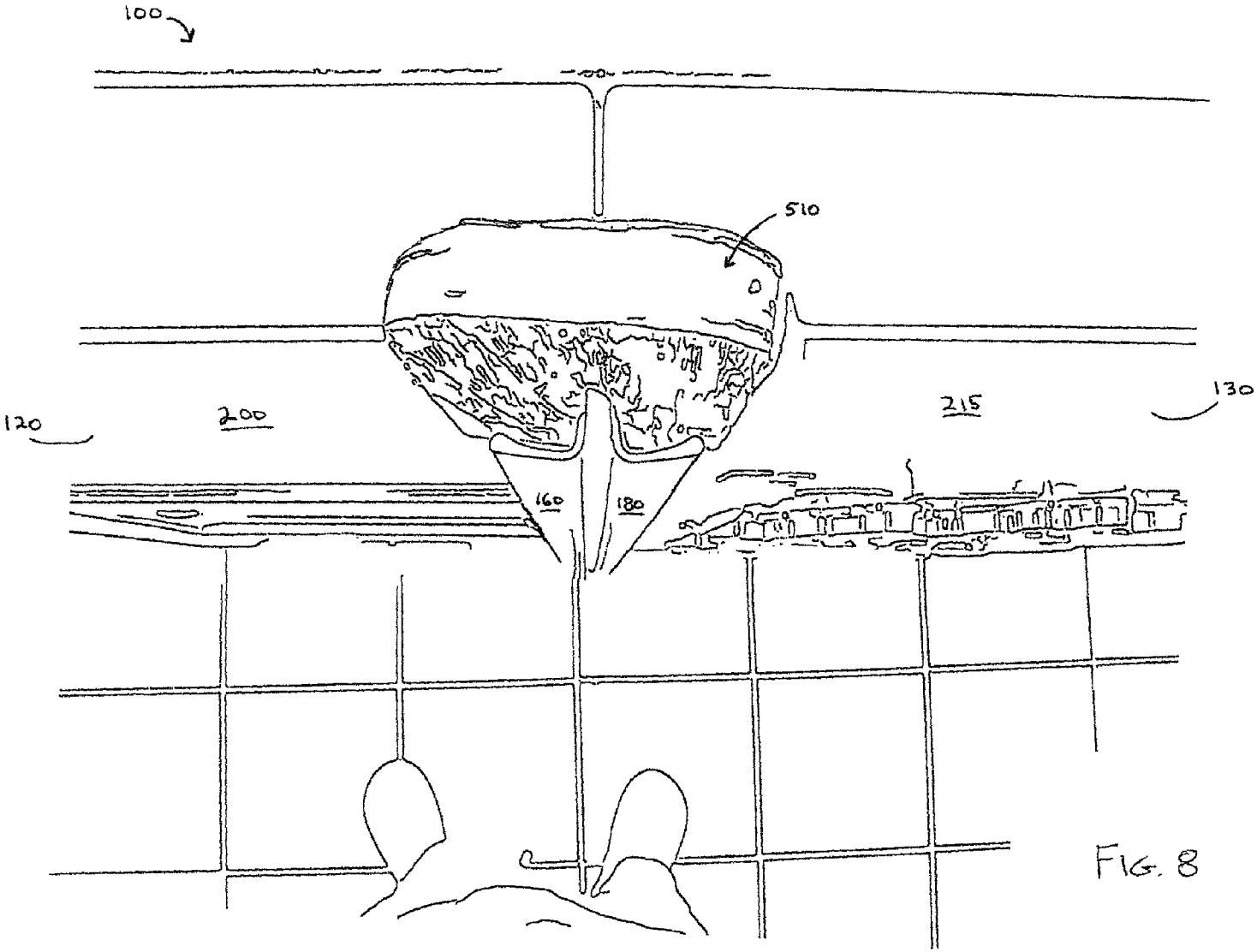
FIG. 8 is a view from above the refrigerator of FIG. 7, showing the door lock apparatus seated in place, thereby locking the doors in a closed position, in accordance with various embodiments.

FIG. 8 is a view from above the refrigerator 100 of FIG. 7, showing the door lock apparatus 510 seated in place, thereby locking the doors 120, 130 in a closed position, in accordance with various embodiments.

Figure 9:
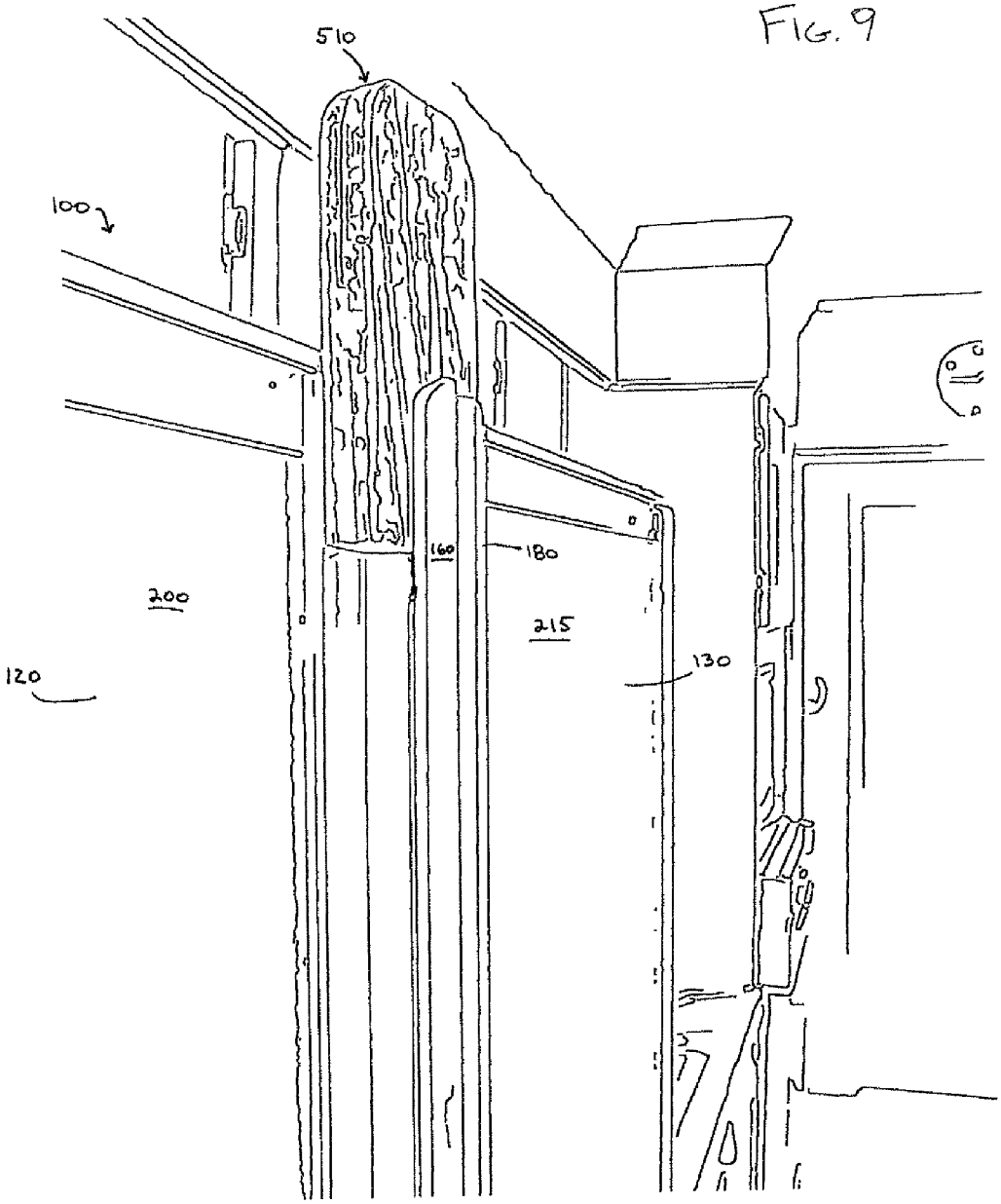
FIG. 9 is a front view, from a diagonal perspective, of the refrigerator of FIG. 7, showing a door lock apparatus seated in place, in accordance with various embodiments.

FIG. 9 is a front view, from a diagonal perspective, of the refrigerator 100 of FIG. 7, showing a door lock apparatus 510 seated in place, in accordance with various embodiments.

In various embodiments, the left and right (also referred to herein as first and second) leg members 520, 530 can be comprised, for example, of a rigid, semi-rigid, and/or resiliently flexible or deformable material. Rigid handles can be advantageous, for example, where the various dimensions of the door-lock apparatus (particularly the surfaces which contact the refrigerator surfaces and door handles) very closely match the receiving areas defined by the refrigerator surfaces and the door handles (e.g., the distance between left and right channels formed by the handles; thicknesses "$T_1$" and width "$T_2$"; and the like dimensions). Semi-rigid or resiliently flexible materials can be useful, for example, where such tolerances are not as strict; for example, permitting at least "quasi-universal" use of the door lock apparatus with refrigerators or cabinets varying between one another in one or more of such dimensions.

Since, in the seated, locking position, the door lock apparatus 510 is located at the top of the refrigerator 100, it is inaccessible to most children due to their height restrictions (typically, children are too short to reach to the top of the refrigerator and remove the door lock apparatus). Adults, however, are typically tall enough to remove the seated door lock apparatus 510, by lifting it out of its seated position, to a position just above the refrigerator (such as shown in FIG. 5). Thus, adult access to the cabinets within the refrigerator is not unduly restricted.

Figure 10:
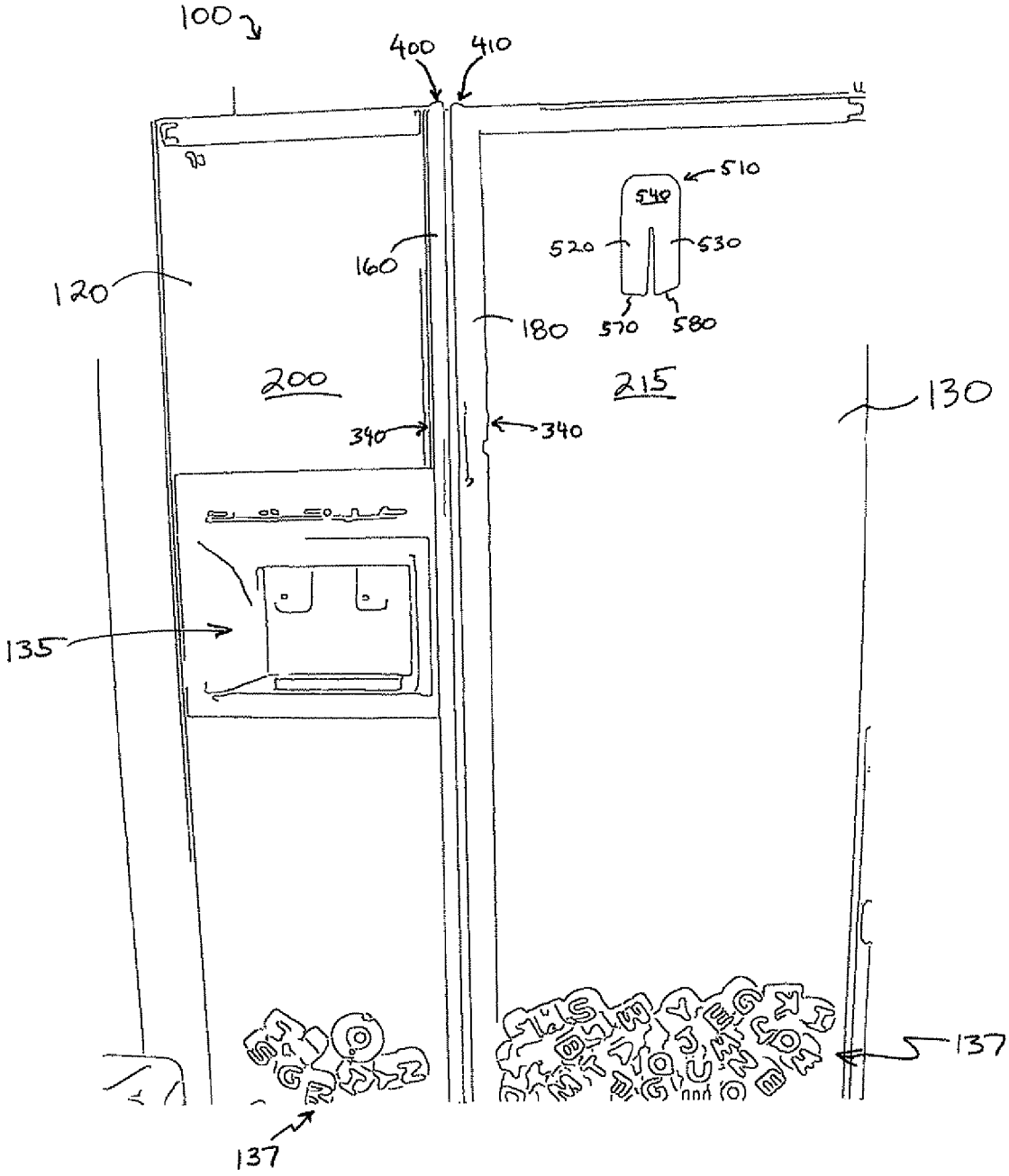
FIG. 10 is a front view showing the door lock apparatus of FIG. 3 removably attached to a front surface of the refrigerator of FIG. 1 via magnetic means, in accordance with various embodiments.

The door locking apparatus 510 can be attached to the refrigerator 100; e.g., via magnet means, such as magnetic attraction between a magnetic strip 545, or magnetic pieces, and a steel sheet comprising refrigerator surface 200 and/or 215. FIG. 10, for example, is a front view showing the door lock apparatus 510 of FIG. 3 removably attached to a front surface of the refrigerator 100 via magnetic means. Such magnetic attachment can be useful, for example, as it allows the door lock apparatus to be easily be removed from the refrigerator surface when it is desired to use it to lock the refrigerator doors in place. In various embodiments, the magnetic attraction between the magnet attached to the door lock apparatus and the refrigerator surface is strong enough to allow the door lock apparatus to stay in place on such surface when not in active use, while at the same time allowing for ready removal by hand when it is desired to remove the lock from the surface for use.

It will be appreciated that the door-lock mechanism can be provided with an appealing design, such as a large tooth (comprising a support member) having left and right roots in spaced relation (comprising leg members) depending therefrom. In such an embodiment, it may be desired for the door-lock mechanism to comprise a white color. Such embodiment would be particularly apt for a refrigerator lock apparatus, for locking a household refrigerator which typically contains food items. Other appealing or fanciful designs could be employed, as well.

It is noted that embodiments of the door lock apparatus taught herein, when in the seated locking position, are resistant to removal by side-to-side action, e.g., pushing or pulling laterally, but rather respond to a generally upward or lifting force in order to be removed and thereby allow opening of the doors. This can be advantageous, e.g., to prevent or reduce the likelihood of unauthorized and/or inadvertent dislodgement, such as by shaking or rocking (e.g., manually by a person, by natural phenomena, e.g., an earthquake, or the like), being hit on the side with an object, or other force having a substantial lateral component.

The foregoing is merely illustrative of the present teachings. As various modifications, changes, and equivalents will occur to those skilled in the art, it is not desired to limit the invention to the exact constructions and methods shown and described above. Accordingly, all modifications, changes, and equivalents which will be appreciated by those skilled in the art are intended to be included within the scope of these teachings.

What is claimed is:

1. An appliance door-locking system, comprising:

(i) a door-lock apparatus including (a) a first elongate leg member; (b) a second elongate leg member; and (c) a web from which each of the first elongated leg member and the second elongated leg member depends, each of the first elongated leg member and the second elongated leg member comprising a respective web end, connected to the web, and a respective distal end opposite the respective web end, wherein at least upper portions of said first and second elongate leg members are disposed in fixed spaced relation relative to one another; said leg members are disposed substantially along a common plane; the first elongated leg member and the second elongated leg member define a spacing therebetween; and the spacing widens in a direction from the web toward the distal ends;

(ii) an appliance including (a) at least one compartment; (b) first and second doors pivotally mounted to said appliance in side-by-side relation, said doors being movable between closed and open positions, whereby access to said one or more compartments from a location outside said appliance can be blocked or allowed, respectively; (c) first and second elongate handles, each extending generally vertically along a face of a respective one of said doors, such that said handles are disposed proximate one another when said doors are in said closed position; wherein said handles each includes a portion spaced forwardly of the face of its respective door, thereby defining first and second elongate channels between portions of said handles and underlying portions of said doors;

(iii) wherein, with said doors in said closed position, said first and second elongate legs are received within said first and second elongate channels, respectively; thereby locking said doors in said closed position;

whereby the widening of the spacing between the first and second leg members enables use of the door-lock apparatus on different handle configurations having different distances between first and second channels in a closed position.

2. The system of claim 1, wherein said appliance is a floor-standing refrigerator at least 5 feet in height, and wherein said handles extend along at least about one half of the height of said refrigerator, with upper ends of said handles terminating at a point within the upper one third of the refrigerator.

3. The system of claim 2, wherein said refrigerator includes at least two temperature-controlled compartments, in side-by-side relation.

4. The system of claim 2, wherein said doors are comprised at least in part of steel sheeting.

5. The system of claim 1, wherein, when oriented for use to lock said doors, said support and elongated leg members define an inverted, generally "U" or "V" shape.

6. The system of claim 5, wherein said first and second legs define first and second axes, with said axes defining an acute angle, relative to one another.

7. The system of claim 1, further comprising a magnet, wherein said magnet is attached to said door-lock apparatus.

8. The system of claim 1, further comprising a tether having a length, with one end of said tether being attached to said door-lock apparatus and a second end of said tether being attached to said appliance.

9. The system of claim 1, wherein said door-lock apparatus is comprised at least in part of one or more resiliently flexible materials.

10. The system of claim 1, wherein said appliance comprises a plurality of external panels, with one or more of said panels being comprised at least in part of a ferromagnetic material, and said door-lock apparatus comprises a magnetic means and is removably attachable to said one or more panels by the magnetic means, when not being used to lock said doors.

11. The system of claim 10, wherein said one or more panels comprised of ferromagnetic material has a surface, said legs of said door-lock apparatus are removably received within said channels, and said magnetic means is not attached to the surface.

12. The appliance door-locking system of claim 1, wherein each of the first and second elongate handles comprises an upper portion and the upper portions of both the first and second elongate handles are received within the spacing.

13. The appliance door-locking system of claim 1, wherein the door-locking apparatus comprises only a single spacing that is between the first and second elongated leg members.

14. A cabinet door-locking system, comprising:

(i) a door-lock apparatus including (a) a first elongate leg member; (b) a second elongate leg member; and (c) a support; wherein said first and second elongate leg members depend from said support in spaced-apart relation relative to one another, a single spacing is defined between the first and second elongate leg members, and said first and second elongate leg members are disposed substantially along a common plane; and (ii) a cabinet including (a) at least one compartment; (b) first and second doors pivotally mounted to said cabinet in side-by-side relation, said doors being movable between closed and open positions, whereby access to said one or more compartments from a location outside said cabinet can be blocked or allowed, respectively; (c) first and second elongate handles, each extending generally vertically along at least a portion of a face of a respective one of said doors, such that said handles are disposed adjacent one another when said doors are in said closed position; wherein each of said handles includes at least a portion spaced forwardly of the face of its respective door, thereby defining first and second elongate channels between respective door-facing portions of said handles and underlying portions of said doors;

(iii) wherein, with said doors in said closed position, said door-lock apparatus is received within said first and second elongate channels and both the first and second elongate handles are received within the single spacing, thereby locking said doors in said closed position; and the single spacing widens in a direction extending along said leg members away from said support;

whereby the widening of the spacing between the first and second leg members enables use of the door-lock apparatus on different handle configurations having different distances between first and second channels in a closed position.

15. The system of claim 14, wherein said leg members are movable towards and away from one another.

16. A method of locking appliance doors in place, comprising:

(i) providing a door-lock apparatus including (a) a first elongate leg member; (b) a second elongate leg member; and (c) a support; wherein said first and second elongate leg members depend from said support, each of the first and second elongate leg members comprises a respective support end connected to the support, and a respective distal end opposite the respective support end, the first and second elongate leg members are disposed in spaced-apart relation relative to one another, the first and second elongate leg members are disposed substantially along a common plane, the first elongated leg member and the second elongated leg member define a spacing therebetween, and the spacing widens in a direction from the web toward the distal ends;

(ii) providing an appliance including (a) at least one compartment; (b) first and second doors pivotally mounted to said appliance in side-by-side relation, said doors being movable between closed and open positions, whereby access to said one or more compartments from a location outside said appliance can be blocked or allowed, respectively; (c) first and second elongate handles, each extending generally vertically along a face of a respective one of said doors, such that said handles are disposed adjacent one another when said doors are in said closed position; wherein said handles each includes at least a portion spaced forwardly of the face of its respective door, thereby defining first and second elongate channels between respective door-facing portions of said handles and underlying portions of said doors, the first and second elongated channels each having a respective top; and (iii) with said doors in said closed position, inserting said door-lock apparatus into said first and second elongate channels from above, at the tops of said first and second elongated channels, to achieve a locking position; thereby locking said doors in said closed position;

whereby the widening of the spacing between the first and second leg members enables use of the door-lock apparatus on different handle configurations having different distances between first and second channels in a closed position.

17. The method of claim 16, wherein, in step (iii), said first and second elongate leg members are simultaneously slidably inserted within said first and second elongate channels, respectively.

18. A method of locking appliance doors in place, comprising:

(i) providing a door-lock apparatus comprising: (a) a first elongate leg member; (b) a second elongate leg member; and (c) a support; wherein said first and second elongate leg members depend from said support and are disposed in spaced-apart relation relative to one another; each of the first elongate leg member and the second elongate leg member comprising a respective support end, connected to the support, and a respective distal end opposite the respective support end; said leg members are disposed substantially along a common plane; and the first elongate leg member and the second elongate leg member define a single spacing therebetween;

(ii) providing an appliance comprising (a) at least one compartment; (b) first and second doors pivotally mounted to said appliance in side-by-side relation, said doors being movable between closed and open positions, whereby access to said one or more compartments from a location outside said appliance can be blocked or allowed, respectively; (c) first and second elongate handles, comprising an upper portion and each extending generally vertically along a face of a respective one of said doors, such that said handles are disposed adjacent one another when said doors are in said closed position; wherein said handles each includes at least a portion spaced forwardly of the face of its respective door, thereby defining first and second elongate channels between respective door-facing portions of said handles and underlying portions of said doors, the first and second elongate channels each having a top; and (iii) with said doors in said closed position, inserting said door-lock apparatus into said first and second elongate channels from above, at the tops of said first and second elongate channels, to dispose the door-lock apparatus in a locking position such that the upper portions of both the first and second elongate handles are received within the single spacing; thereby locking said doors in said closed position;

wherein the single spacing widens in a direction from the support ends toward the distal ends; and whereby the widening of the spacing between the first and second leg members enables use of the door-lock apparatus on different handle configurations having different distances between first and second channels in a closed position.

19. A cabinet door-locking system, comprising:

a door-lock apparatus including (a) a first elongate leg member; (b) a second elongate leg member; (c) a support, with said first and second elongate leg members depending from said support in spaced-apart relation relative to one another; and (d) a single spacing defined between said first and second elongate leg members; and a cabinet including (a) at least one compartment; (b) first and second doors pivotally mounted to said cabinet in side-by-side relation, with (i) said first door including a first elongate edge along an upper portion thereof, and (ii) said second door including a second elongate edge along an upper portion thereof; and (c) first and second handles, each disposed on a face of a respective one of said doors, and each including at least a portion spaced forwardly of the face of its respective door;

wherein said first and second doors are configured for movement between closed and open positions, whereby access to said one or more compartments from a location outside said cabinet can be blocked or allowed, respectively;

wherein, with said doors in said closed position, (i) at least portions of said first and second elongate edges are disposed adjacent one another, and (ii) said first and second elongate edges are received within said single spacing; whereby said doors are locked in the closed position;

and further wherein the single spacing widens in a direction extending along said leg members away from said support;

whereby the widening of the spacing between the first and second leg members enables use of the door-lock apparatus on different cabinet-door configurations having different sizes of elongate edges of doors.

* * * * *